US005806611A

United States Patent [19]

Van Den Steen et al.

[11] Patent Number: 5,806,611

[45] Date of Patent: Sep. 15, 1998

[54] DEVICE FOR CONTROLLING WEIGHT ON BIT OF A DRILLING ASSEMBLY

[75] Inventors: Leon Van Den Steen; Djurre Hans Zijsling, both of GD Rijswijk, Netherlands

[73] Assignee: Shell Oil Company, Houston, Tex.

[21] Appl. No.: 656,499

[22] Filed: May 31, 1996

[30] Foreign Application Priority Data

May 31, 1995 [EP] European Pat. Off. ..... 95201424

[51] Int. Cl.[6] ..... E21B 7/06

[52] U.S. Cl. ..... 175/27; 175/325.2; 175/321

[58] Field of Search ..... 175/61, 73, 50, 175/325.2, 321, 27

[56] References Cited

U.S. PATENT DOCUMENTS

| | | | |
|---|---|---|---|
| 1,558,511 | 10/1925 | Smith . | |
| 4,120,198 | 10/1978 | Tanguy et al. | 73/152.48 |
| 4,275,795 | 6/1981 | Beimgraben et al. | 175/26 |
| 4,518,048 | 5/1985 | Varley | 175/61 |
| 4,660,656 | 4/1987 | Warren et al. | 175/26 |
| 4,768,598 | 9/1988 | Reinhardt | 175/26 |
| 4,901,806 | 2/1990 | Forrest | 175/321 |
| 5,205,364 | 4/1993 | Juergens et al. | 175/38 |
| 5,311,954 | 5/1994 | Quintana | 175/321 X |
| 5,421,420 | 6/1995 | Malone et al. | 175/61 |
| 5,484,029 | 1/1996 | Eddison | 175/73 |

FOREIGN PATENT DOCUMENTS

| | | |
|---|---|---|
| 762749 | 12/1956 | European Pat. Off. . |
| 755207 | 10/1954 | United Kingdom . |
| 2183272 | 10/1986 | United Kingdom . |

*Primary Examiner*—Frank Tsay

[57] ABSTRACT

A device for controlling weight on bit of a drilling assembly for drilling a borehole in an earth formation, is provided. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

13 Claims, 7 Drawing Sheets

DEVICE FOR CONTROLLING WEIGHT ON BIT OF A DRILLING ASSEMBLY

BACKGROUND OF THE INVENTION

The present invention relates to a device for controlling weight on bit of a drilling assembly for drilling a borehole in an earth formation. In the technology of drilling wellbores the compressive force between the drill bit and the lower end of the borehole is generally referred to as weight on bit (WOB). Such force is required to achieve penetration of the rotating drill bit into the earth formation. Other factors governing the rate of penetration of the drill bit are, for example, the type and size of the bit, the rotational speed of the bit and the hardness of the rock formation. In a vertical borehole the weight on bit is largely determined by the weight of the drill string, the drilling fluid pressure and the vertical tension exerted to the drill string at surface. In strongly deviated or horizontal boreholes a considerable amount of axial force is dissipated by frictional forces between the drill string and the borehole wall, and consequently the vertical tension at surface, i.e. the hook load, does not provide accurate information about the WOB. In such cases a thruster is generally applied to provide the necessary weight on bit. Both in applications with or without a thruster, the drilling fluid pressure is an important parameter determining the weight on bit.

A problem frequently occurring in drilling of wellbores is the variation of the weight on bit due to varying drilling fluid pressure in the drill string. Such pressure variations occur, for example, by torque variations of a hydraulic downhole motor driving the drill bit, or by fluid pressure pulses generated during measurement while drilling (MWD). Such fluid pressure variations tend to elongate the drill string, resulting in variation of the weight on bit. Obviously the tendency for the drill string to elongate is more pronounced in case a thruster is incorporated in the drill string. In case a downhole motor is applied to drive the drill bit, the variations in the weight on bit can cause stalling of the downhole motor thereby hampering drilling and eventually leading to damage to the motor.

U.S. Pat. No. 1,558,511 discloses a device for controlling weight on bit of a drilling assembly for drilling a borehole in an earth formation, the device comprising a fluid passage for drilling fluid pumped through the drilling assembly; and control means for controlling the flow resistance of drilling fluid in said passage. The control means consists of a piston moving in a cylinder and thereby gradually covering or uncovering a bypass channel. A spring is arranged in the cylinder so as to bias the piston to a position in which the bypass channel is covered by the piston, and the fluid pressure acts on both sides of the piston. The weight on bit of the known device is limited to the weight of the lowermost part of the assembly with the compressive force of the spring added thereto.

SUMMARY OF THE INVENTION

It is an object of the invention to provide an improved device for controlling weight on bit, which allows a sufficiently high weight on bit to be applied.

In accordance with the invention there is provided a device for controlling weight on bit of a drilling assembly for drilling a borehole in an earth formation, the device comprising

- a fluid passage for drilling fluid pumped through the drilling assembly; and
- control means for controlling the flow resistance of drilling fluid in said passage in a manner that said flow resistance increases when the fluid pressure downstream the passage decreases and that said flow resistance decreases when the fluid pressure downstream the passage increases.

It is thus achieved that when the fluid pressure downstream the passage decreases the pressure drop across the passage increases, and conversely, when the fluid pressure downstream the passage increases the pressure drop across the passage decreases. Thus any pressure variation downstream the passage will lead to a reduced, or even vanishing, pressure variation upstream the passage, and therefore a reduced tendency of the drill string to elongate.

To achieve maximum benefit of the reduced tendency of the drilling assembly to elongate, it is preferred to locate the device in a lower end part of the drilling assembly.

Suitably a downhole motor driving the drill bit is arranged in the drilling assembly, between the device and the drill bit.

In accordance with a further aspect of the invention there is provided a hydraulic thruster comprising telescoping upper and lower members, the thruster being provided with the device according to the invention. Preferably said device is provided in said lower member.

With the thruster according to the invention it is achieved that an increasing fluid pressure downstream the thruster, e.g. to increase the fluid pressure at the fluid inlet of a downhole motor, does not automatically lead to an increasing thrust force. Conversely, a decreasing fluid pressure at the motor inlet does not automatically lead to a decreasing thrust force.

DESCRIPTION OF THE DRAWINGS

The invention will be described hereinafter in more detail and by way of example, with reference to the accompanying drawings, in which.

In the Figures similar features, or features having similar function, have been indicated by similar reference numerals.

DESCRIPTION OF THE PREFERRED EMBODIMENTS

Figure 1:
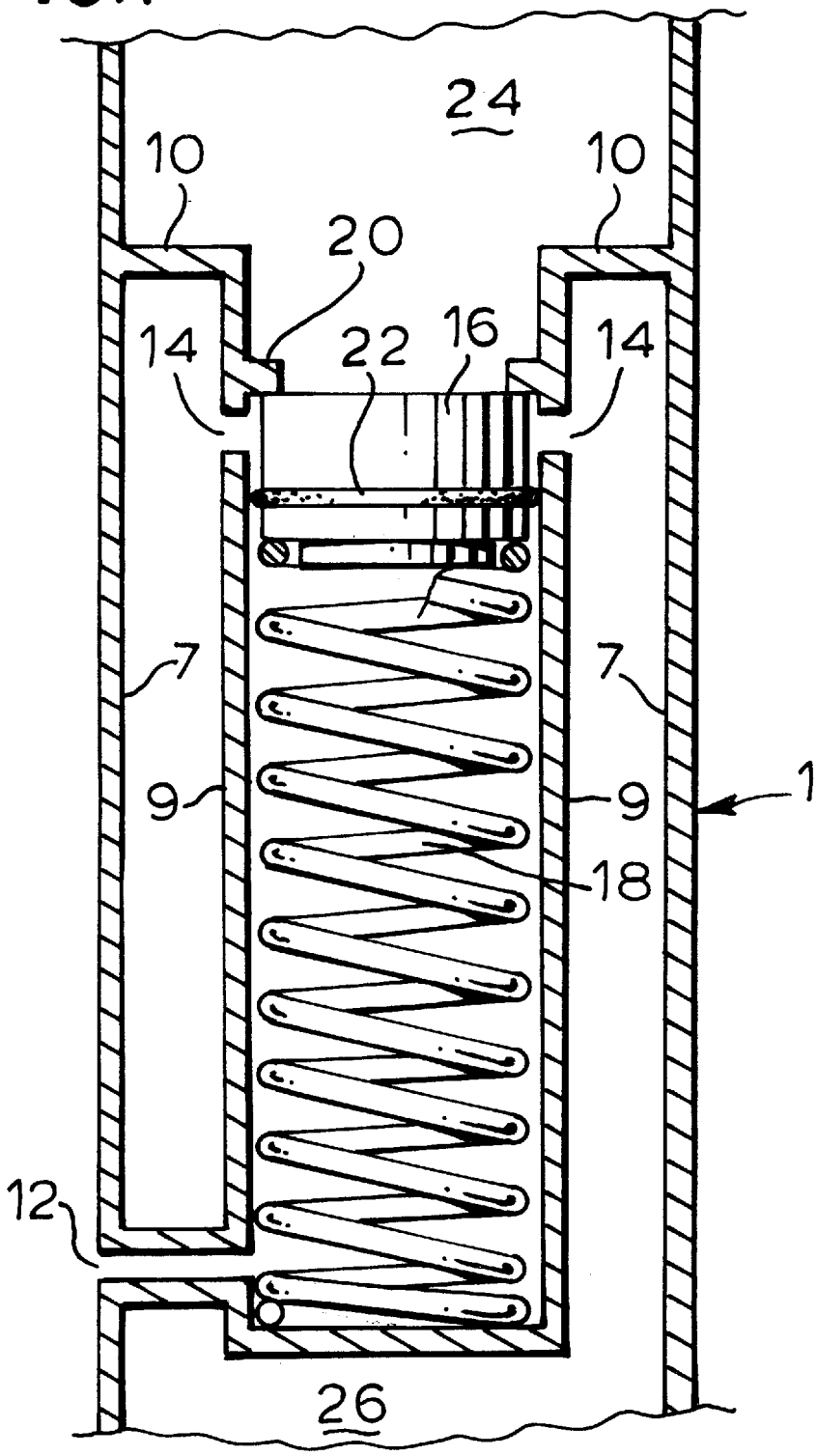
FIG. 1 shows schematically an embodiment of the device according to the invention.

Referring to FIG. 1 there is shown a longitudinal cross-section of a drill string 1 provided with the device according to the invention. The device includes a cylinder 9 having an open upper end connected by an annular plate 10 to the drill string 1. The cylinder 9 is closed at its lower end, and a fluid channel 12 provides fluid communication between the lower end of the cylinder 9 and the exterior of the drill string 1. Openings 14 are provided in the wall of the inner cylinder 9 adjacent the upper end thereof. A piston 16 is longitudinally movable in the inner cylinder 9, which piston 16 is biased upwardly by a helical spring 18 so that the piston 16 rests against a shoulder 20. The piston 16 is sealed from the inner surface of the cylinder 9 by seal 22. In the position shown in FIG. 1 the piston 16 closes the openings 14 thereby preventing fluid communication between a space 24 formed by the interior of the drill string 1 upstream the device, and a space 26 formed by the interior of the drill string 1 downstream the device.

During normal operation of the device drilling fluid is pumped through the drill string 1, thereby urging the piston 16 downwardly against the force of spring 18 so that the openings 14 become at least partly uncovered by the piston 16. The drilling fluid flows from space 24 via the openings 14 to space 26 and further to a drill bit (not shown) arranged at the lower end of the drill string 1, thereafter returning to surface through the annular space between the drill string 1 and the borehole (not shown). Optionally a downhole motor (not shown) is included in the drill string to drive the drill bit, the drilling fluid then flowing from space 26 to the inlet of the downhole motor. Since the drilling fluid in the drill string 1 is under increased pressure compared to the drilling fluid surrounding the drill string 1, there is a tendency for the drill string to elongate elastically. It is this tendency which affects the weight on bit, whereby the weight on bit tends to increase with increasing pressure difference between the interior and the exterior of the drill string 1. It will be clear that such pressure difference depends, inter alia, on the flow resistance of the drilling fluid at openings 14, the pressure-drop across the downhole motor, and the size of the drill bit nozzles (not shown). The degree to which the piston 16 moves downwards depends on the spring force and the pressure difference between the space 24 and the exterior of the thruster 1. When the fluid pressure in space 26 increases, e.g. due to increased torque of the downhole motor or due to changing bit/formation interaction, the fluid pressure in space 24 also increases by virtue of the fact that spaces 24, 26 are in communication via openings 14. Thus the pressure difference between the space 24 and the exterior of the thruster 1 increases so that the piston 16 moves further downwards thereby further uncovering the openings 14 and decreasing the flow resistance of the fluid at these openings. As a result the pressure difference between the space 24 and the exterior of the string 1 has increased less than the pressure difference between the space 26 and the exterior of the string 1. Thus the tendency of the drill string 1 to elongate, and therefore the weight on bit, is reduced compared to a conventional drill string without the device according to the invention. It will be clear that this weight on bit control is achieved as long as the piston 16 has not fully uncovered the openings 14. Thereafter no further compensation takes place, and it is evident that the size of the openings 14 and the spring force are design parameters which have to be selected in accordance with expected operating conditions.

Figure 2:
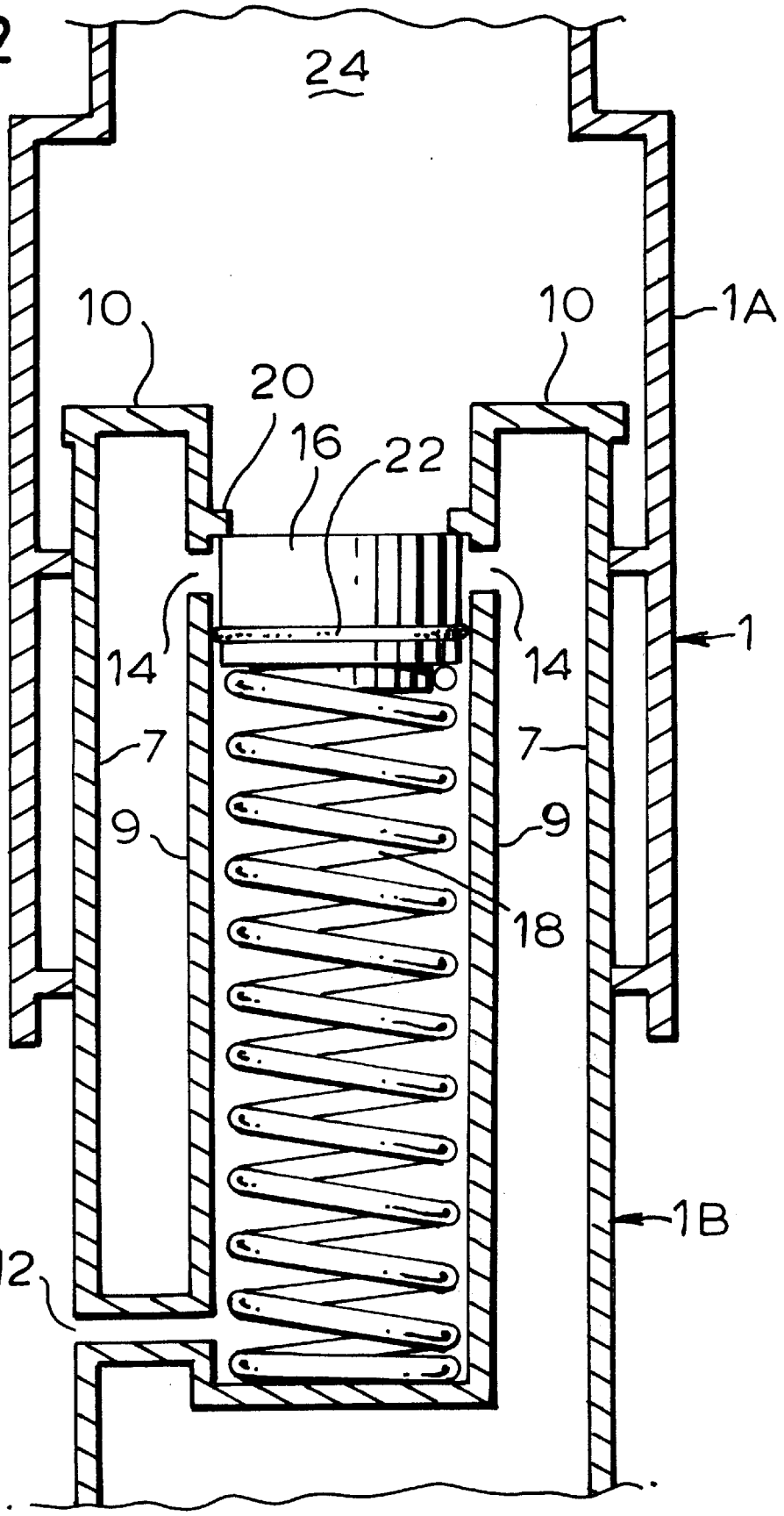
FIG. 2 shows schematically a thruster provided with the device according to the invention.

In FIG. 2 is shown a drill string 1 provided with a hydraulic thruster comprising an upper member 1A connected at its upper end to an upper part of the drill string 1, and a lower member 1B connected at its lower end to a lower part of the drill string 1 including a downhole motor (not shown) driving a drill bit (not shown). The two members 1A, 1B are essentially of tubular shape, and the lower member 1B extends into the upper member 1A in a telescoping arrangement therewith. Suitable torque transmitting means (not shown), e.g. a spline arrangement, is provided to transmit torque between the two members. The lower member 1B is provided with the device of FIG. 1, whereby plate 10 is connected to the upper end of member 1B.

Normal operation of the device of FIG. 2 is similar to normal operation of the device described with reference to FIG. 1.

However, the thruster provides increased control of weight on bit, and additionally functions as a shock absorber by virtue of the telescoping movement of the lower member 1B. The device according to the invention serves as a fluid pressure regulator, in that pressure variations occurring in space 26, i.e. in the lower end part of the drill string 1, are reduced (or even eliminated) in space 24, i.e. in the upper part of the drill string 1. Since the thrust force delivered by the thruster depends on the pressure difference between space 24 and the drill string exterior, thrust force variations due to pressure variations in space 26 are reduced (or eliminated) by the application of the device.

Figure 3:
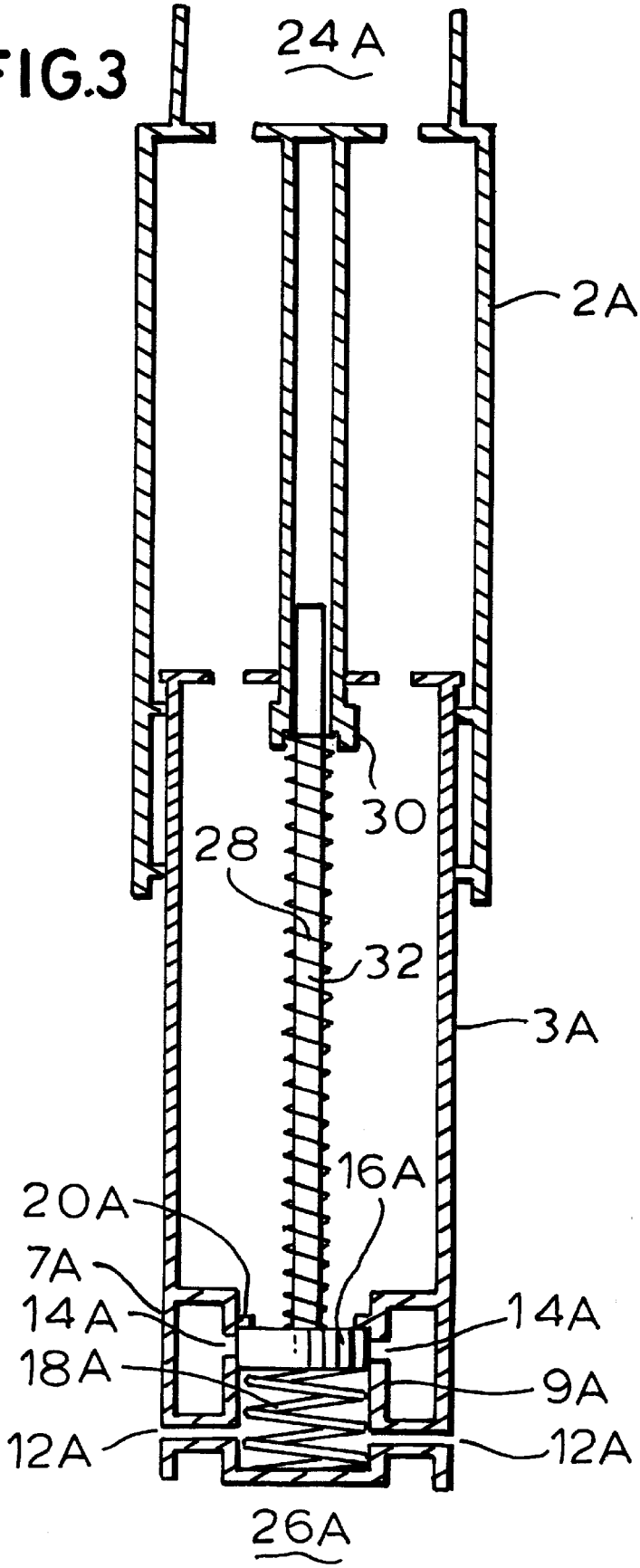
FIG. 3 shows schematically an alternative thruster provided with the device according to the invention.

In FIG. 3 is shown an alternative thruster largely similar to the thruster shown in FIG. 2, as it includes telescoping upper and lower members 2A, 3A, cylinder 9A, openings 14A, piston 16A, helical spring 18A, shoulder 20A, pressure communication channels 12A and spaces 24A and 26A, all these features having similar functions as the corresponding features of the embodiment shown in FIG. 2.

The embodiment of FIG. 3 additionally includes a second helical spring 28 which is at one end thereof biased against a tubular element 30 fixed to the upper member 2A, and at the other end biased against piston 16A, thereby counteracting the spring force of spring 18A. The second spring 28 surrounds bar 32 which is fixed to the piston 16A and axially guided through tubular element 30. The spring 28 is so dimensioned that its spring force, when the members 2A, 3A are fully telescoped inwardly, is lower than the spring force of spring 18A when piston 16A rests against shoulder 20A.

Normal use of the FIG. 3 embodiment is largely similar to normal use of the FIG. 2 embodiment. However, spring 28 allows control of the degree to which the openings 14A are uncovered by piston 16A, in that the drilling operator is able to control the total spring force acting on piston 16A by axially moving the upper part of the drill string through the borehole thereby compressing or decompressing spring 28. The degree of compression of spring 28 affects the total spring force acting on the piston 16A and thus also the position of the piston 16A relative to the openings 14A.

Figure 4:
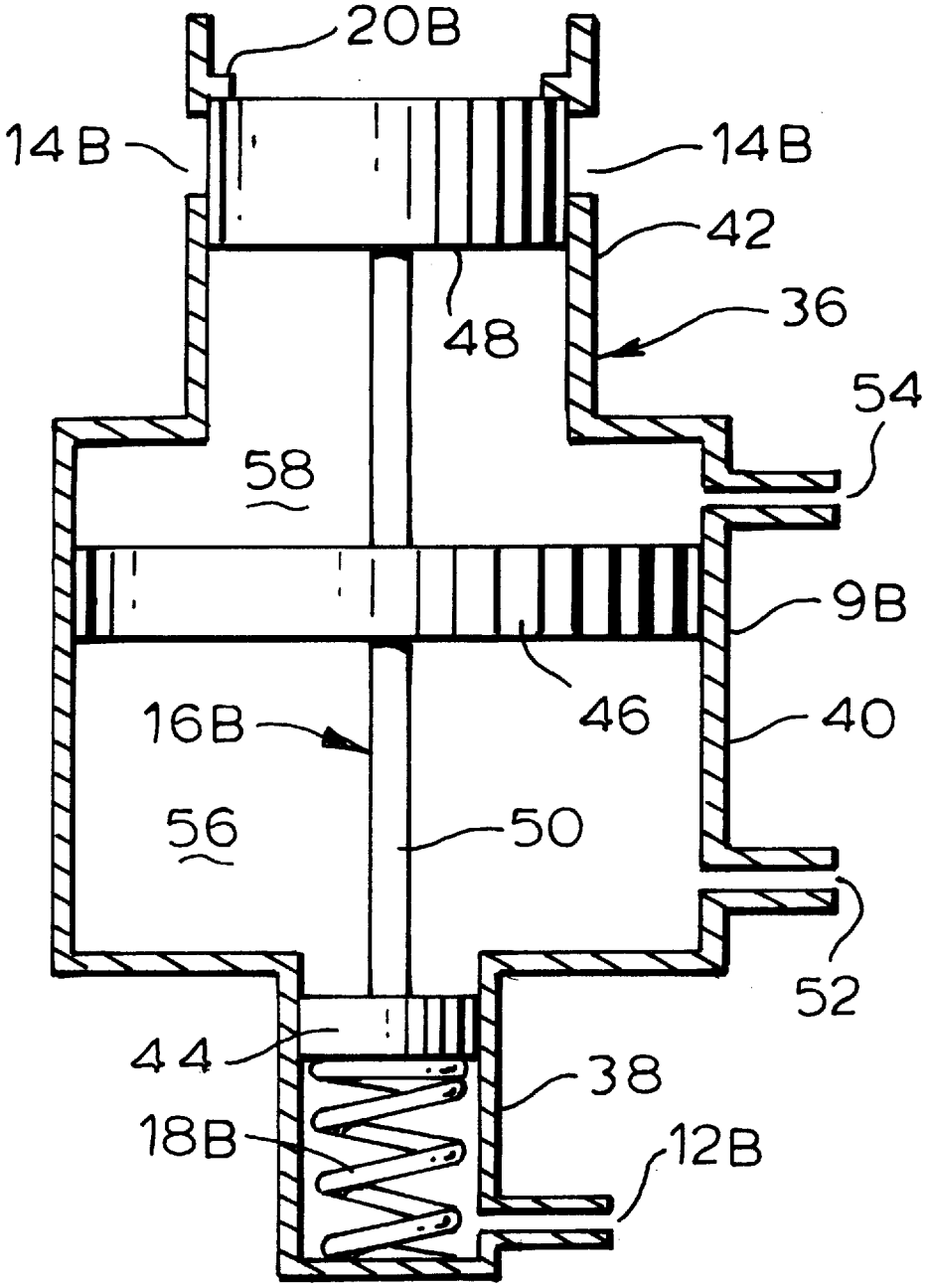
FIG. 4 shows schematically another embodiment of the device according to the invention.

In FIG. 4 is shown another embodiment of the device according to the invention. The device forms a pressure regulator 36 including a cylinder 9B having three sections 38, 40, 42 of mutually different diameters. A piston assembly 16B is arranged in the inner cylinder 9B, which assembly 16B includes a lower piston 44 located in cylinder section 38, an intermediate piston 46 located in cylinder section 40 and an upper piston 48 located in cylinder section 42, the pistons 44, 46, 48 being interconnected by a rod 50. A helical spring 18B biases the piston assembly 16B against annular shoulder 20B provided in the upper cylinder section 42. The cylinder section 40 is provided with ports 52, 54 providing fluid communication between respective spaces 56, 48 of cylinder 9B and a selected location in the drilling assembly. For example, port 52 can be connected to space 24 or 24A of the embodiments shown in FIGS. 2 and 3 respectively.

Normal operation of the pressure regulator 36 is similar to normal operation of the device described with reference to FIG. 1 albeit that the ports 52, 54 provide a means to further control the degree to which the piston 48 uncovers the openings 14B. Such control can be achieved by connecting the ports to locations of selected pressure.

Figure 5:
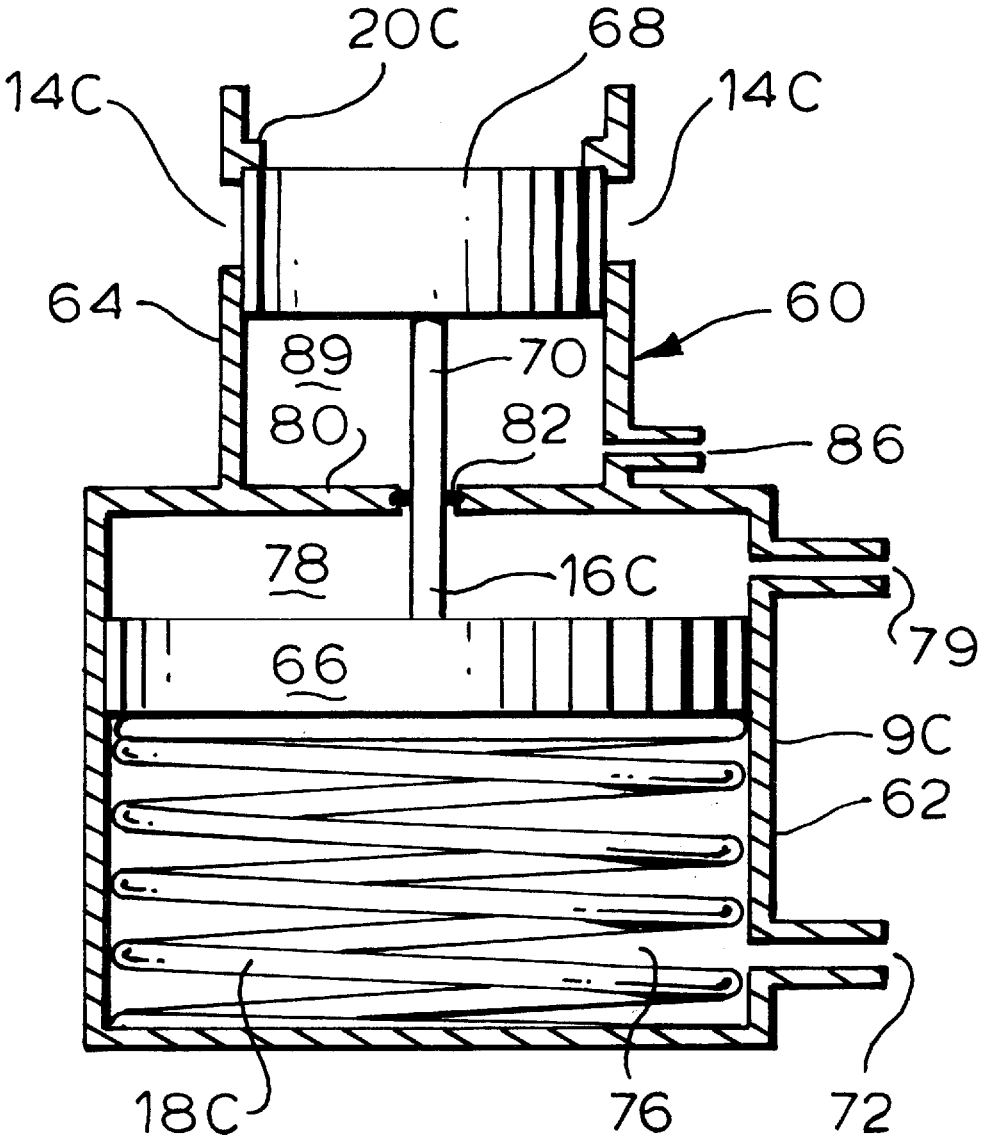
FIG. 5 shows schematically a further embodiment of the device according to the invention.

In FIG. 5 is shown a further embodiment of the device according to the invention, in the form of pressure regulator 60. The pressure regulator 60 includes a cylinder 9C having two sections 62, 64 of mutually different diameters. A piston assembly 16C is arranged in the inner cylinder 9C, which assembly 16C includes a lower piston 66 located in cylinder section 62 and an upper piston 68 located in cylinder section 64, the pistons 66, 68 being interconnected by a rod 70. A helical spring 18C biases the piston assembly 16C against annular shoulder 20C provided in the upper cylinder section 64. The cylinder section 62 is provided with ports 72, 74 providing fluid communication between respective spaces 76, 78 of inner cylinder 9C and a suitable location in the drilling assembly. The space 78 is enclosed by the wall of cylinder section 62, the lower piston 66, and a partitioning disc 80 arranged at the transition between cylinder sections 62, 64 and having a central opening through which rod 70 extends. A seal 82 seals the disc 80 from the rod 70. Thus a space 84 is enclosed between the wall of the cylinder section 64, the disc 80 and the upper piston 68, which space 84 is in fluid communication with a location of selected pressure via port 86.

Normal operation of the pressure regulator 60 is similar to normal operation of the pressure regulator described with reference to FIG. 1, however the ports 72, 74, 86 provide a means to further control the degree to which the piston 68 uncovers the openings 14C. Such control can be achieved by connecting the ports to locations of selected pressure.

Figure 6:
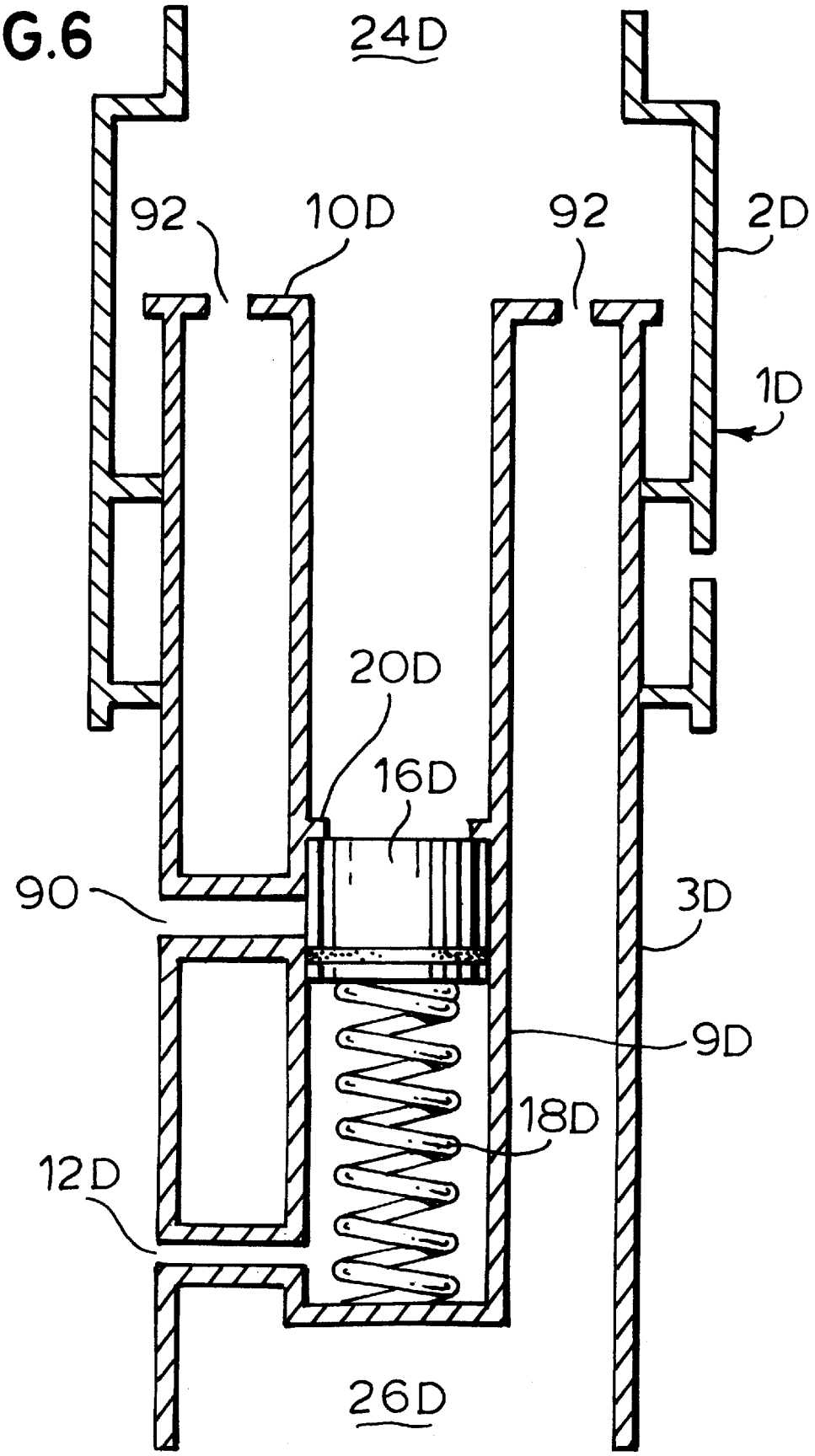
FIG. 6 shows schematically a further thruster provided with the device according to the invention.

In FIG. 6 is shown a further thruster 1D provided with the device according to the invention. Thruster 1D is largely similar to the thruster shown in FIG. 2, as it includes telescoping upper and lower members 2D, 3D, cylinder 9D, annular plate 10D, piston 16D, helical spring 18D, shoulder 20D, pressure communication channel 12D and spaces 24D and 26D, all these features having similar functions as the corresponding features described with reference to FIG. 2. The inner cylinder 9D, the spring 18D and the piston 16D form a pressure regulator assembly. The thruster 1D differs from the thruster of FIG. 2 mainly in that the inner cylinder communicates via port 90 with the exterior of the thruster, i.e. with the annular space between the thruster 1D and the borehole wall (not shown). Port 90 is fully covered by piston 16D when the latter is in its uppermost position, and is gradually uncovered as the piston 16D is pressed downwards due to an increasing pressure difference between space 24D and the exterior of the thruster 1D. A further difference with the FIG. 2 embodiment is that annular plate 10D is provided with ports 92.

During normal operation drilling fluid is pumped through the thruster 1D, the major part of the fluid flowing from space 24D via ports 92 to space 26D. A smaller part of the drilling fluid flows through port 90 to the exterior of the thruster when piston 16D gradually uncovers port 90. In this manner a high flow rate of drilling fluid through the thruster 1D is allowed, while at the same time pressure regulation is achieved since the flow resistance of the drilling fluid decreases by virtue of the piston 16D gradually uncovering port 90 when the pressure difference between space 24D and the exterior of the thruster increases, and vice versa.

Figure 7:
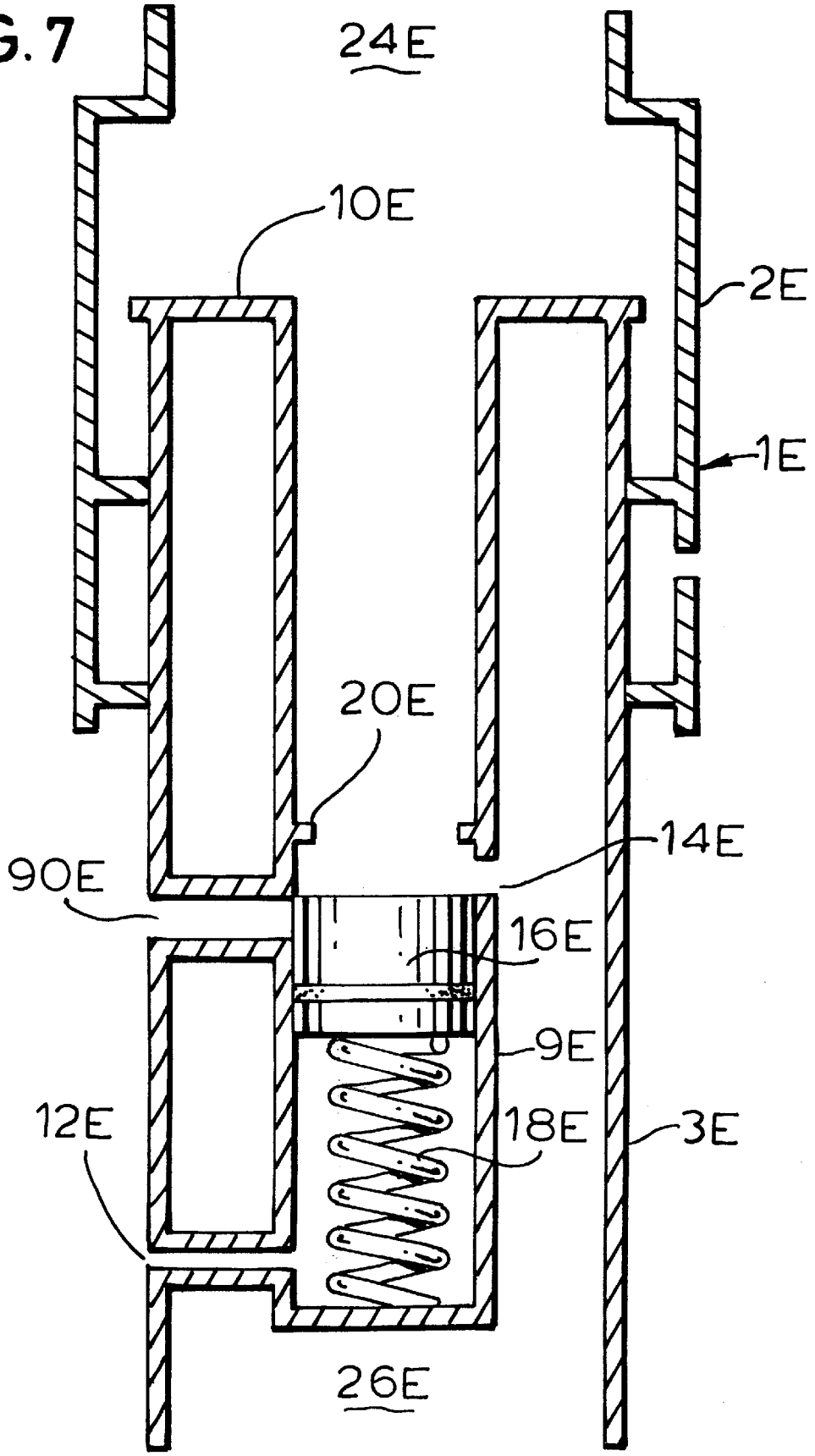
FIG. 7 shows schematically yet another thruster provided with the device according to the invention.

In FIG. 7 is shown yet another thruster provided with the device according to the invention, being essentially a combination of the embodiments of FIGS. 2 and 6. The device is incorporated in thruster 1E which is largely similar to thruster 1D shown in FIG. 6, the difference being that no fluid ports are provided in annular plate 10E, and that cylinder 9E is provided with opening 14E which provides fluid communication between spaces 24E and 26E. Similarly to the thruster of FIG. 2, opening 14E is fully covered by piston 16E when the latter is biased against annular ring 20E. As the pressure difference between space 24E and the exterior of the thruster 1E increases, piston 16E is pressed downwards thereby gradually uncovering opening 14E and allowing drilling fluid to flow from space 24E via opening 14E to space 26E. When the opening 14E is fully uncovered and the pressure difference further increases, the piston 16E is pressed further downwards thereby gradually uncovering port 90E and allowing a part of the drilling fluid to flow from space 24E to the exterior of the thruster 1E.

Instead of the downhole motor being arranged between the device according to the invention, or the hydraulic thruster according to the invention, and the drill bit, the device or the hydraulic thruster can alternatively be arranged between the downhole motor and the drill bit.

What is claimed is:

1. A device for controlling weight on bit of a drilling assembly for drilling a borehole in an earth formation, the device comprising a fluid passage for drilling fluid flowing through the drilling assembly; and control means for controlling the flow resistance of the drilling fluid in said passage in a manner that said flow resistance increases when the fluid pressure in the passage decreases and that said flow resistance decreases when the fluid pressure in the passage increases.

2. The device of claim 1, wherein said control means comprises at least one flow restriction for drilling fluid flowing through said passage, and means to vary the cross-sectional area of each flow restriction in dependence of the fluid pressure in the passage.

3. The device of claim 2, wherein said device comprises a cylinder, said flow restriction includes an opening in a wall of said cylinder, and said means to vary the cross-sectional area of the flow restriction flow area comprises a piston axially movable in the cylinder between a position in which the opening is substantially covered by the piston and a position in which the opening is substantially uncovered by the piston.

4. The device of claim 3, further comprising spring means to bias the piston to the position in which the opening is substantially covered by the piston.

5. The device of claim 4, further comprising means to control the force by which the piston is biased to the position in which the opening is substantially covered by the piston.

6. The device of claim 5, wherein said piston forms a primary piston and said means to control the force includes at least one secondary piston axially movable in the cylinder, said secondary piston operated by a pressure differential thereacross, which secondary piston acts on said primary piston.

7. The device of claim 6, wherein said means to control the force includes a helical spring at one end biased against primary the piston and at the other end biased against an upper part of the drilling assembly which telescopes relative to the primary piston, the length of the helical spring being controllable by movement of said upper part of the drilling assembly through the borehole.

8. The device of claim 7, wherein said flow restriction provides fluid communication between an interior of the drilling assembly upstream the device and the interior of the drilling assembly downstream the device.

9. The device of claim 8, wherein a downhole motor driving the drill bit is arranged between the device and the drill bit.

10. The device of claim 9, wherein said flow restriction provides fluid communication between the interior of the drilling assembly upstream the device and the interior of the drilling assembly between the downhole motor and the drill bit.

11. The device of claim 7, wherein said flow restriction provides fluid communication between the interior of the drilling assembly upstream the device and an annular space between the drilling assembly and the borehole wall.

12. The device of claim 11, comprising at least two said flow restrictions, a first flow restriction providing fluid communication between the interior of the drilling assembly upstream the device and the interior of the drilling assembly downstream the device, and a second flow restriction providing fluid communication between the interior of the drilling assembly upstream the device and the interior of the drilling assembly between the downhole motor and the drill bit.

13. The device of claim 12, wherein the device is arranged in a lower end part of the drilling assembly.

* * * * *